United States Patent [19]

Knowles

[11] 4,227,342

[45] Oct. 14, 1980

[54] THUMB TWIDDLING TOY

[75] Inventor: Horace A. Knowles, 506 G St., SW., Washington, D.C. 20024

[73] Assignee: Horace A. Knowles, Washington, D.C.

[21] Appl. No.: 55,746

[22] Filed: Jul. 6, 1979

[51] Int. Cl.[3] ..... A63H 33/26; A63H 1/32; A63B 67/00; A63B 59/00

[52] U.S. Cl. ..... 46/228; 46/1 R; 46/47; 46/49; 46/175 R; 46/193; 46/45; 272/1 R; 272/67; 272/93; 273/1 R; 273/DIG. 24; 273/DIG. 26

[58] Field of Search ..... 46/47, 1 R, 49, 177, 46/190, 191, 228, 193, 175 R, 45; 273/1 R, DIG. 24, DIG. 26; 272/1 R, 27 R, 93, 116, 117, 67

[56] References Cited

U.S. PATENT DOCUMENTS

| | | | |
|---|---|---|---|
| 3,073,594 | 1/1963 | Byrd | 272/1 R |
| 3,360,261 | 12/1967 | Smolensky | 272/67 |
| 3,533,185 | 10/1970 | Kanbar | 272/67 |
| 3,533,405 | 10/1970 | Collins | 272/67 |
| 3,612,521 | 10/1971 | Wendeborn | 272/67 |
| 3,738,651 | 6/1973 | Norman | 272/67 |
| 4,006,556 | 2/1977 | Williams | 46/47 |
| 4,105,200 | 8/1978 | Unger | 272/67 |

*Primary Examiner*—Gene Mancene
*Assistant Examiner*—Michael J. Foycik, Jr.
*Attorney, Agent, or Firm*—Browdy and Neimark

[57] ABSTRACT

A novelty toy used to facilitate thumb twiddling comprises a pair of closely spaced, parallel, tubular holes each adapted to receive the first digit of a thumb, the walls of the holes being smooth and slippery, and of diameter slightly larger than the thumbs. The thumbs are inserted into the holes and are rotated orbitally about an imaginary axis between the two holes.

14 Claims, 10 Drawing Figures

FIG.1
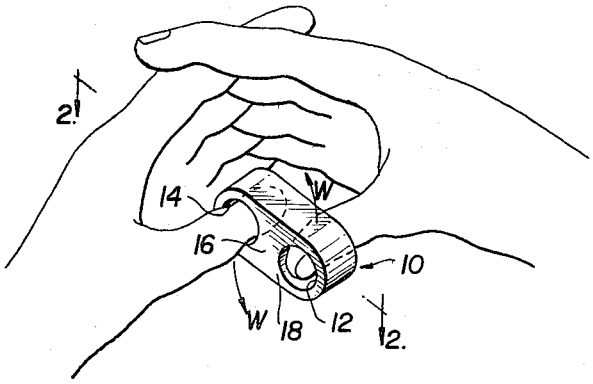
FIG.2
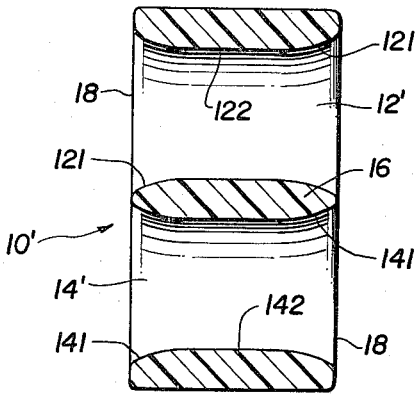
FIG.3
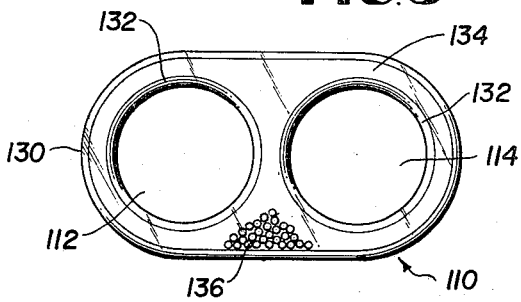
FIG.4
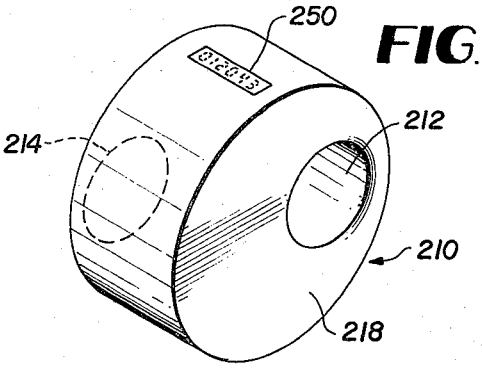
FIG.5
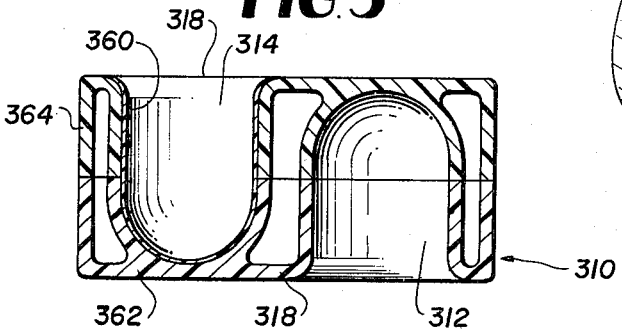
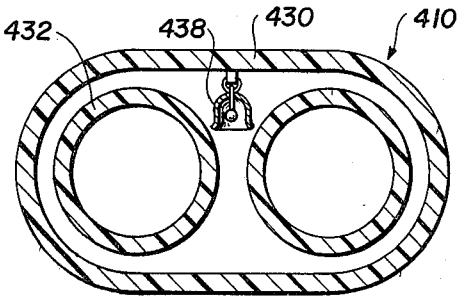
FIG.6
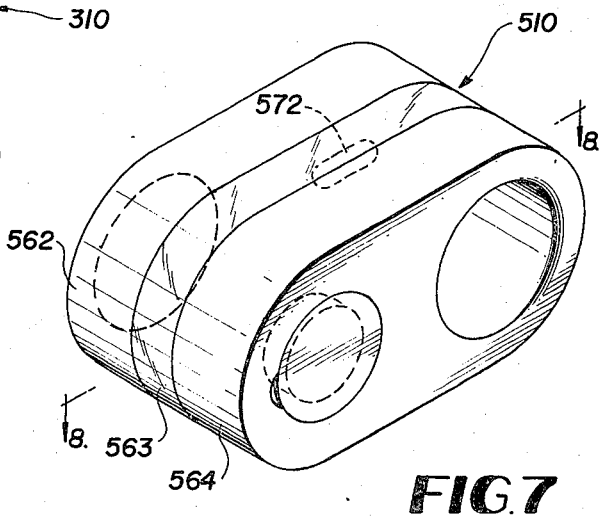
FIG.7

THUMB TWIDDLING TOY

FIELD OF INVENTION

The present invention relates to a novelty amusement toy and, more particularly, to a thumb twiddling toy.

BACKGROUND

There has been known from time immemorial the idle pastime of what is commonly called "twiddling the thumbs." This relaxing pastime consists of the rotation of two thumbs about another, i.e., orbitally about an imaginary axis between the two thumbs. The forefingers of one hand are usually clasped by the forefingers of the other hand during thumb-twiddling.

Heretofore no equipment has been available to the thumb twiddler to assist him in the twiddling procedure. To those twiddlers who lack sufficient coordination, not only is the repose and peace of mind which thumb twiddling normally brings not available, but the inability to carry out the twiddling successfully, including the inadvertent bumping of the thumbs against one another during the twiddling motion, causes additional frustration. Furthermore, the provision of suitable equipment, not heretofore available, could improve the pleasure of the thumb twiddling for even those highly skilled in the art.

SUMMARY

Accordingly, it is an object of the present invention to provide for improved thumb twiddling.

It is another object of the invention to provide an amusing, rotating device that is powered by rotation of the two thumbs of a person's hand about one another.

It is still another object of the invention to provide a thumb twiddling toy.

It is yet a further object of the invention to provide a novelty toy which assists the user in twiddling his thumbs.

Another object is to provide a device having two parallel holes spaced closely adjacent one another, which device slips over the ends of both thumbs loosely and rotates as the thumbs are rotated around one another.

These and other objects in accordance with the instant invention are achieved according to the invention by the provision of a thumb twiddling toy of structure defining two closely spaced parallel holes which fit loosely over the thumbs and which are generally conformed to inhibit slipping of the thumbs from the holes during the rotary twiddling motion. The device may conform to the general curvature of the thumb, or axial wall means may be provided to prevent slippage. Signaling and/or counting means may be provided to register and/or count each rotation.

For a better understanding of the invention, as well as the above and other objects and the nature and advantages of the instant invention, possible embodiments thereof will now be described with reference to the attached drawing, it being understood that these embodiments are intended to be merely exemplary and in no way limitative.

BRIEF DESCRIPTION OF DRAWING

FIG. 1 is a perspective view of an embodiment of the instant invention in use;

FIG. 2 is a cross-sectional view along line 2—2 of FIG. 1;

FIG. 3 is an end view of another embodiment in accordance with the present invention;

FIG. 4 is a perspective view of yet another embodiment of the instant invention;

FIG. 5 is a cross-sectional view of still another embodiment of the instant invention;

FIG. 6 is a cross-sectional view of still another embodiment of the instant invention;

FIG. 7 is a perspective view of still another device in accordance with the instant invention;

DETAILED DESCRIPTION OF EMBODIMENTS

Figure 8:
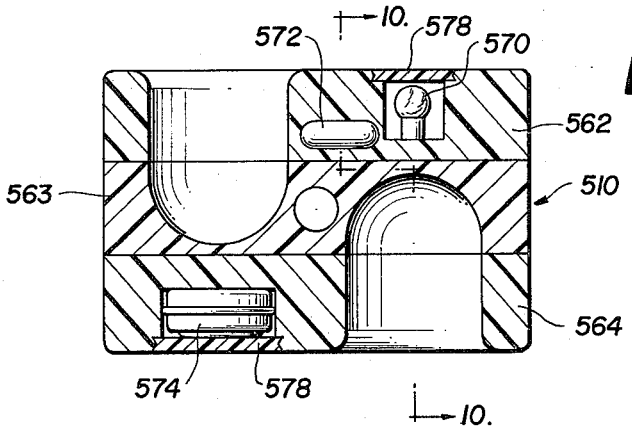
FIG. 8 is a cross-sectional view taken along line 8—8 of FIG. 7.

FIG. 1 shows a device 10, in accordance with the present invention, in use. As can be seen, the device 10 is provided with two parallel holes 12 and 14 separated by an intermediate portion 16, all of which extend between two faces 18, 18. The user inserts his/her thumbs through the holes 14, 16 in opposite directions from opposite faces 18 as shown, the four fingers of one hand normally clasping the four fingers of the other hand as depicted. The device 10 is then powered to rotate in the direction shown by arrows W by the rotation of the two thumbs about one another through an axis extending parallel to the openings 12 and 14 and passing through the intermediate portion 16.

The exterior shape of the twiddler is not critical, except that its exterior dimensions must be such that during twiddling the device is able to clear the space between the user's fingers and thumbs. Thus, the device may be elongated as shown in FIGS. 1, 3, 6, 7, or circular, i.e., having circular faces, as shown in FIG. 4, although other exterior shapes such as a figure 8 shape, also are possible.

The width of the intermediate portion 16 is quite important. If this width is too large, twiddling becomes quite difficult. In general, it is desired that the width of portion 16 be no greater than about ⅓ the thickness of a normal thumb, e.g., no more than about ⅜-inch wide. More desirably, the width of portion 16, for an adult sized model, should be about 1/32 to 3/16 inch.

Referring to the embodiment of FIG. 2, it is seen that the openings 12' and 14' may be suitably curved or shaped laterally so as to conform to the curvature of the thumbs when held in position for twiddling. Thus, both openings 12' and 14' are wider at their ends 121 and 141, adjacent the faces 18 of the device, and smoothly taper to a narrower diameter in the middle 122, 142.

A similar embodiment 110 is shown in FIG. 3, in which holes 112 and 114 may be similar to those of embodiment 10' of FIG. 2, or alternatively similar to those of the embodiment of FIG. 5, discussed below. The twiddler 110 is, however, suitably formed of clear plastic, such as polymethyl methacrylate, having spaced walls 130 and 132 defining a connected pair of generally annular hollow spaces 134 therebetween. A plurality of colored pellets are sealed in the hollow 134 and these can be seen through the transparent wall 130. As the twiddler 110 is twiddled, the pellets 136 continuously move creating a pleasing, and in many cases an almost hypnotic, visual effect.

The pellets or beads 136 may be of the same or of different colors, or may be of reflective or pearlescent appearance. The space 134 may also be filled with a fluid other than air, e.g., a liquid which in combination with the pellets 136 creates additional pleasing visual effects. The pellets 136 may be formed to provide a swishing sound as the device 110 is rotated; for example, the pellets may be formed of a soft material, such as polyethylene, polypropylene, rubber or foamed plastic. Alternatively, the pellets may be formed of metal or hard plastic so that a clicking sound is created as the twiddler 110 is rotated.

FIG. 4 shows an embodiment 210 having circular faces 218. As in the other embodiments, the twiddler 218 has a pair of parallel holes including a first hole 212 and a second hole 214 shown in phantom, the nature of the two holes 212, 214 being described below with reference to FIG. 5. The model 210 may incorporate various other features disclosed in relation to other models such as those disclosed below. It is desirably formed of light weight plastic, preferably opaque or translucent, such as PVC, polyethylene, polypropylene or polystyrene, or it can be formed of more expensive materials such as metals, thermoset plastics including fiberglass reinforced materials, or polycarbonate resin. However, it is most desirably formed with spaced walls such as shown in FIGS. 3, 5 and 6, and of light weight material, so that it will be light in weight.

The twiddler 210 is shown with a readout 250 of a counter mechanism, such as an electronic digital readout of the LED type. For example, such a device may be battery powered (see FIG. 8) through a circuit having a gravity controlled switch, such as a mercury switch (see FIG. 10); during each complete rotation of the twiddler 210, the gravity switch once turns the circuit on and then off, powering the counter 250 so that it counts the number of rotations. As an alternative to an electronic counter, a mechanical counter of the pendulum type used in pedometers may be used (e.g., Kuhn U.S. Pat. No. 770,644; Biro U.S. Pat. No. 3,818,194). The model 210 is particularly suitable for a counting mechanism as its circular shape provides for more internal space to house the counter mechanism.

FIG. 5 shows a twiddler 310 which constitutes in cross-section a form which can be taken by both models 110 (FIG. 3) and 210 (FIG. 4). Each face 318 is provided with a hole 312 and 314 in the form of depressions or cups, the bottoms of which are closed. The cups 312, 314 are of a depth selected to receive approximately only the first joint of each thumb, suitably 1 to 1½ inches. Such cups 312, 314 are, as are the holes in other embodiments, of a diameter so that the thumbs fit thereinto fairly loosely, i.e. in a manner so that the thumbs can rotate freely in the cups as they are rotated orbitally about a central axis during the twiddling operation; on the other hand the cups 312, 314 should not be so large that the thumbs could be bent at a sharp angle relative to the sides of the cups.

As is readily apparent, pressure applied by the thumbs to the inner wall surfaces of the holes 12, 14, 12', 14' or the cups 312, 314 causes rotation of the twiddler, and it is further apparent that the twiddler can be rotated in either direction, i.e. clockwise or counterclockwise. But as the inner wall surfaces of the twiddler must slide relative to the thumbs, it is desirable that such inner wall surfaces defining the holes 12, 14 or cups 312, 314 be very smooth and, preferably slick or slippery. This is another reason for forming the device from a material such as polyethylene or polypropylene, both of which are slick. Another alternative is to coat the openings or cups with a layer 360 of slick material such as PTFE (Teflon), polyethylene, etc., which coating aids the thumbs to rotate smoothly and with very little friction being created by the movement of the thumbs against the walls of the holes or cups.

As noted above, various plastics are well suited for formation of most twiddler models. Plastics are easily and inexpensively molded and an embodiment 10 or 10' can be easily molded in one piece, while an embodiment 310 can be molded in two pieces 362 and 364 and joined together such as with adhesive or by welding.

FIG. 6 shows a model 410 which, like models 110, 210 and 310, is formed of spaced walls 430 and 432. In this device 410 there is provided a suitable sounding device such as a bell 438 suspended in the space between the walls 430 and 432. Each time the twiddler 410 is rotated the bell 438 sounds, thereby providing a pleasant melodious sound.

Figure 9:
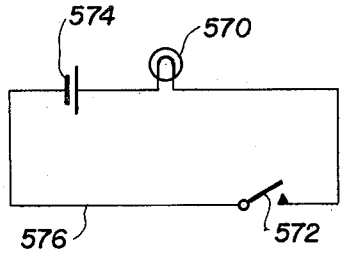
FIG. 9 is a circuit diagram showing operation of a device in accordance with FIGS. 7 and 8.
Figure 10:
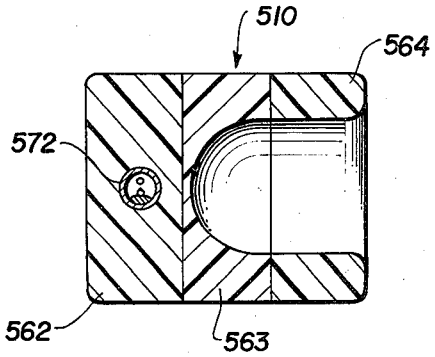
FIG. 10 is a cross-sectional view taken along line 10—10 of FIG. 8.

A similar embodiment 510 is shown in FIGS. 7–10, but instead of providing an audible signal as does the model 410, the twiddler 510 provides a visual signal by means of a suitable light bulb 580, such as the type which uses very little current and is normally used on pocket flashlights. FIGS. 8 and 10 show that the twiddler 510 may be molded in three parts 562, 563 and 564 and then joined with cement or heat.

FIG. 9 shows a simple circuit which can be used to power the bulb 570, including a switch 572 and a battery 574. The switch 572 should be a gravity switch such as a mercury switch. The battery is desirably of the alkaline type and may be, as illustrated in FIG. 8, of the button type. Suitable wires 576 connect the elements. For removal and replacement of the battery 574 and bulb 570, suitable doors 578 are provided.

It will be clear that various changes can be made without departing from the invention. For example, the exterior surface of the twiddler can be provided with various visual effects, e.g., designs or solid colors including gold and silver. A spiral design such as the type used on barber's poles, or other designs which appear to move symetrically during motion, are possibilities. Other possible power sources include inertial motors and spring wound motors.

The foregoing description of the specific embodiments will so fully reveal the general nature of the invention that others can, by applying current knowledge, readily modify and/or adapt such specific embodiments without departing from the generic concept, and, therefore, such adaptations and modifications are intended to be comprehended within the meaning and range of equivalents of the disclosed embodiments. It is to be understood that the phraseology and terminology employed herein is for the purpose of description and not of limitation.

What is claimed is:

1. A device for use in twiddling the thumbs comprising: first means to rotate about the first digit of a first thumb comprising a first cylindrical wall member defining a first hole of diameter slightly larger than the diameter of the thumb, said first wall member being smooth and of a length approximately equal to the length of the first digit of the thumb. second means to rotate about the first digit of a second thumb comprising a second cylindrical wall member defining a second hold of diameter slightly larger than the diameter of the thumb, said second wall member being smooth and of length approximately equal to the length of the first digit of the thumb; said first circular wall member being spaced from said second circular wall member by an intermediate portion of width no greater than about ⅓ the thickness of the thumb.

2. A device in accordance with claim 1 of elongated unitary structure having two opposite faces, the first and second holes extending through the structure between said faces.

3. A device in accordance with claim 1 further comprising means to conform to the shape of the curvature of the top of the first digit of the thumb, said means comprising curves in said first and second walls so that the diameters of said first and second holes are smaller at the center thereof compared with the diameter adjacent at least one end thereof.

4. A device in accordance with claim 1 formed of light-weight plastic.

5. A device in accordance with claim 1 wherein at least the interior surfaces of said first and second cylindrical walls are formed of a slippery material.

6. A device in accordance with claim 1 further comprising an outer wall surrounding said first and second walls, said first, second and outer walls being connected by a pair of spaced face walls, said device having open space between said walls.

7. A device in accordance with claim 6 wherein said face walls and said outer wall are formed of transparent plastic, and a visual effect material is provided in the open space.

8. A device in accordance with claim 6 wherein said face walls are circular and said outer wall is cylindrical.

9. A device in accordance with claim 1 further comprising means to designate each revolution of said device.

10. A device in accordance with claim 9 wherein said means to designate each revolution comprises means for creating an audible signal for each revolution.

11. A device in accordance with claim 9 wherein said means to designate each revolution comprises means for creating a visual signal for each revolution.

12. A device in accordance with claim 11 wherein said means for creating a visual signal is a counter means.

13. A device in accordance with claim 11 wherein said means for creating a visual signal is a light source.

14. A device in accordance with claim 1 having first and second opposite faces, the first hole extending through said device from the first face thereof and terminating at the second face without extending therethrough, and the second hole extending through said device from the second face thereof and terminating at the first face without extending therethrough, so as to define a pair of thumb cups facing in opposite directions.

* * * * *